US005997333A

United States Patent [19]

Konda et al.

[11] Patent Number: 5,997,333

[45] Date of Patent: Dec. 7, 1999

[54] LOCKING DEVICE FOR HIGH-VOLTAGE CABLE CONNECTORS

[75] Inventors: Kazumoto Konda; Sho Miyazaki; Shuichi Kanagawa; Tsutomu Tanaka; Kunihiko Watanabe, all of Yokkaichi, Japan

[73] Assignee: Sumitomo Wiring Systems, Ltd., Japan

[21] Appl. No.: 08/908,356

[22] Filed: Aug. 7, 1997

Related U.S. Application Data

[62] Division of application No. 08/695,296, Aug. 9, 1996.

[51] Int. Cl.[6] ..... H01R 13/627

[52] U.S. Cl. ..... 439/352; 439/348

[58] Field of Search ..... 439/352, 348, 439/350, 353, 351, 354, 355, 356, 357, 358

[56] References Cited

U.S. PATENT DOCUMENTS

| | | | |
|---|---|---|---|
| 3,319,213 | 5/1967 | Mas . | |
| 3,422,390 | 1/1969 | Tucker . | |
| 3,684,321 | 8/1972 | Hundhausen et al. . | |
| 3,888,559 | 6/1975 | Geib . | |
| 5,195,905 | 3/1993 | Pesci | 439/352 |

FOREIGN PATENT DOCUMENTS

| | | |
|---|---|---|
| 0 050 575 | 4/1982 | European Pat. Off. . |
| 0 341 419 | of 1989 | European Pat. Off. . |
| 0 633 629 A1 | 1/1995 | European Pat. Off. . |
| 2 092 396 | of 1982 | United Kingdom . |
| 2 092 396 | 8/1992 | United Kingdom . |

OTHER PUBLICATIONS

Japanese Industrial Standard JIS S 2135—"Quick Coupling Unit For Gas Appliances", Japanese Standards Association, Feb. 1, 1991.

*Primary Examiner*—Michael L. Gellner
*Assistant Examiner*—Antoine Ngandjui
*Attorney, Agent, or Firm*—Anthony J. Casella; Gerald E. Hespos

[57] ABSTRACT

To securely lock connectors for charging, a charging connectors 1 is engaged with a vehicle-side connector 25, lock balls 9 are engaged with an engaging groove 28 and a locking member 10 is engaged with the lock balls 9. As a result, the connectors 1 and 25 are locked. Since the connectors 1 and 25 are locked by a ball lock mechanism taking advantage of the engagement of the lock balls 9, the connectors can be more securely locked even if the connectors and wires are heavy as compared to a prior art locking mechanism adopting an elastically deformable resin lance or engaging member and, therefore, a better reliability can be ensured.

10 Claims, 5 Drawing Sheets

LOCKING DEVICE FOR HIGH-VOLTAGE CABLE CONNECTORS

This application is a division of application Ser. No. 08/695,296 filed Aug. 9, 1996 which application is now: pending.

BACKGROUND OF THE INVENTION

1. Field of the Invention

The present invention relates to a locking device or construction for connectors and to a use thereof for a charging connector used for charging and/or for a high-voltage cable connector.

2. Description of the Prior Art

An electric vehicle includes a vehicle-side connector secured to the vehicle body and connected with a battery mounted on the vehicle. The battery is charged or recharged with a charger. More particularly, a charger-side connector is connected with the charger via a flexible cable. Charging is performed with the charger-side connector engaged with the vehicle-side connector. In such a case, it is necessary to provide a locking means for locking the connectors so as to prevent the charger-side connector from disengaging from the vehicle-side connector during charging.

A locking mechanism that has been used in a wiring harness includes a mechanism for lockingly engaging an elastically deformable resin lance or engaging member formed in the connector with an engaging portion formed in a mating connector.

A wiring harness type of locking mechanism with a resin engaging member is not well suited for use in a charging connector for the following reason. When the charger-side connector is engaged with the vehicle-side connector, the locking mechanism bears the weight of the charger-side connector and the weight of wires extending from the charger-side connector. Since the wires used for charging are thicker and heavier than those used for the wiring harness, the locking mechanism adopting the resin engaging member cannot sufficiently bear the weight of the wires for charging.

The present invention was developed to avoid the above problem, and an object thereof is to securely lock connectors, in particular used for charging.

SUMMARY OF THE INVENTION

According to the invention there is provided a locking device for connectors, comprising: an engaging means which comprises a locking part engageable with an engaged or inserted mating connector and is displaceable in a radial direction between an engaging position where the locking projection or part is substantially engaged with the mating connector and a retracted position where the locking part is substantially disengaged from the mating connector, and an engaging means restricting member capable of restricting the displacement of the engaging means to its retracted position.

According to a preferred embodiment, the engaging means comprises an elastic engaging member being elastically displaceable in a radial direction between the engaging position and the retracted position.

Preferably, the engaging means restricting member comprises a deformation restricting member capable of restricting the elastic deformation of the elastic engaging member to its retracted position.

Further preferably, the engaging means is movable along an insertion direction relatively to the mating connector between a lock position where the displacement, in particular elastic displacement thereof to its retracted position is restricted by the engaging means restricting member, in particular deformation restricting member and an unlock position where the displacement, in particular elastic displacement thereof to its retracted position is permitted.

Still further preferably, the locking construction further comprises a lock spring for biasing the engaging means, in particular elastic engaging member toward its lock position.

Most preferably, the engaging means projects from a locking member being particularly cylindrical, which is fitted around the outer surface of a connector housing and the locking part projects inward of the housing, and/or wherein the engaging means restricting member is a substantially cylindrical member fitted around the outer surface of the engaging means.

According to still a further preferred embodiment of the invention, the engaging means comprises one or more lock balls which are displaceable in radial directions, and the engaging means restricting member comprises a locking member being displaceable between a lock position where it engages the lock balls and causes them to be engaged with the mating connector and an unlock position where it permits the lock balls to displace in a disengaging direction from the mating connector.

Preferably, the locking further comprises a connector housing for accommodating at least one terminal particularly connected with a wire, which terminal is connectable with at least one mating terminal of the mating connector, and an engaging portion being in particular cylindrical, which is formed in the connector housing so as to be engageable with the mating connector in substantially a longitudinal direction particularly corresponding to a direction of insertion of the mating connector and formed with engaging means holes, in particular ball support holes, which are open in the circumferential or peripheral surface thereof.

Further preferably, the lock balls are displaceable fitted in the ball support holes displaceable in radial directions and in the lock position project from the outer surface of the engaging portion such that projected portions thereof engage the inserted mating connector to hold the connectors connected.

Still preferably, the locking device further comprises a lock spring for biasing the locking member toward its lock position and biasing the lock balls in such a direction as to be engaged with the mating connector, and/or an unlocking member which is displaceable to a position where it permits the engagement of the lock balls with the mating connector when the mating connector is inserted in the engaging portion, and particularly an unlock spring for biasing the lock balls in such a direction as to be disengaged from the mating connector, in particular via the unlocking member.

According to a further preferred embodiment, the locking device further comprises an operable member which is operable particularly while the connector housing is held in one hand, and a linking mechanism for displacing the locking member to its unlock position when the operable member is operated.

According to the invention there is further provided a use of the inventive locking device for a charging connector for an automotive vehicle and/or for a high-voltage cable connector.

According to a preferred embodiment of the invention, there is provided a locking construction, in particular a charging connector, comprising:

a connector housing for accommodating a terminal connected with a wire which terminal is connectable with a mating terminal, a cylindrical engaging portion formed in the connector housing so as to be engageable with a mating connector and formed with ball support holes which are open in the outer surface thereof, lock balls which are displaceably fitted in the ball support holes in radial directions and project from the outer surface of the cylindrical engaging portion such that projected portions thereof engage the mating connector engaged with the cylindrical engaging portion to hold the connectors connected, and a locking member displaceable between a lock position where it engages the lock balls and causes them to be engaged with the mating connector and an unlock position where it permits the lock balls to displace in a disengaging direction from the mating connector.

Accordingly, when the mating connector is engaged with the cylindrical engaging portion, the lock balls are engaged with the mating connector and the locking member is displaced to the lock position to hold the lock balls engaged with the mating connector. Accordingly, the connectors can be securely locked.

Further, when the locking member is displaced to the unlock position, the lock balls are permitted to displace in the disengaging direction from the mating connector. Thus, the connectors can be unlocked.

Thus, since the connectors are locked by the ball lock mechanism for engaging the lock balls displaceable in the ball support holes with the mating connector, they can be securely locked even if the connectors and wires are heavy as compared with the locking mechanism adopting an elastically deformable engaging member. Accordingly, an excellent reliability can be ensured.

Preferably the charging connector, further comprises:

a lock spring for biasing the locking member toward its lock position and biasing the lock balls in such a direction as to be engaged with the mating connector, an unlocking member which is displaceable to a position where it permits the engagement of the lock balls with the mating connector as the mating connector is engaged with the cylindrical engaging portion, and an unlock spring for biasing the lock balls in such a direction as to be disengaged from the mating connector via the unlocking member.

Accordingly, when the mating connector is engaged with the cylindrical engaging portion, the unlocking member is displaced against the biasing force of the unlock spring; the lock balls are automatically engaged with the mating connector by the biasing force of the lock spring; and the locking member is automatically displaced to its lock position to lock the lock balls. Thus, the connectors are locked.

Further, when the locking member is displaced to its unlock position against the biasing force of the lock spring, the lock balls are disengaged from the mating connector by the biasing force of the unlock spring. Thus, the connectors are unlocked.

Thus, the connectors are automatically locked if the cylindrical engaging portion and the mating connector are engaged, and are unlocked only by displacing the locking member to its unlock position. Accordingly, an excellent operability can be ensured.

Preferably the charging connector further comprises:

an operable member which is operable while the connector housing is held in one hand, and a linking mechanism for displacing the locking member to its unlock position when the operable member is operated.

Accordingly, when the operable member is operated while the connector housing is held in one hand, the locking member is displaced to its unlock position via the linking mechanism, thereby unlocking the connectors.

Thus, since the connectors can be unlocked while the connector housing is held in one hand, an excellent operability can be ensured.

According to a further preferred embodiment of the invention, there is provided a locking construction for connectors, comprising:

an elastic engaging member which comprises a locking projection engageable with an engaged mating connector and is elastically displaceable in a radial direction between an engaging position where the locking projection is engaged with the mating connector and a retracted position where the locking projection is disengaged from the mating connector, and a deformation restricting member capable of restricting the elastic deformation of the elastic engaging member to its retracted position.

With this construction, when the mating connector is engaged, the locking projection is engaged with the mating connector, and the deformation restricting member restricts the displacement of the elastic engaging member to its retracted position, with the result that the connectors are locked. The connectors are unlocked when the elastic engaging member is elastically displaced to its retracted position and the locking projection is disengaged from the mating connector.

The above locking construction has fewer parts and can be more easily assembled as compared with the locking construction adopting the lock balls.

Preferably, the elastic engaging member is movable along an engaging direction with the mating connector between a lock position where the elastic displacement thereof to its retracted position is restricted by the deformation restricting member and an unlock position where the elastic displacement thereof to its retracted position is permitted.

With this construction, when the mating connector is engaged, the locking projection is engaged with the mating connector, and the elastic engaging member moves to its lock position and is held in its engaging position by the deformation restricting member. As a result, the connectors are locked. When the elastic engaging member moves to its unlock position and moves to its retracted position, it is disengageable from the mating connector, i.e. the connectors are unlocked.

Further preferably, the locking construction further comprises a lock spring for biasing the elastic engaging member toward its lock position.

With this construction, the engaged mating connector comes into contact with the locking projection and moves the elastic engaging member toward its lock position against the biasing force of the lock spring. When the elastic engaging member is disengaged from the deformation restricting member and elastically displaced to its retracted position, the locking projection is disengaged from the mating connector. When the mating connector reaches a specified position, the locking projection is engaged with the mating connector by the elastic restoring force of the elastic engaging member, and the elastic engaging member moves to its lock position by the biasing force of the lock spring to restrict its displacement to the retracted position. As a result, the connectors are held locked.

Still further preferably, the elastic engaging member projects from a cylindrical locking member fitted around the outer surface of a connector housing and the locking projection projects inward, and that the deformation restricting member is a cylindrical member fitted around the outer surface of the elastic engaging member.

With this construction, when the mating connector is engaged, the locking projection is engaged with the mating connector and the deformation restricting member restricts the displacement of the elastic engaging member to its retracted position, with the result that the connectors are locked. The connectors are unlocked when the elastic engaging member is elastically displaced to its retracted position and the locking position is disengaged from the mating connector.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENTS

Figure 1:
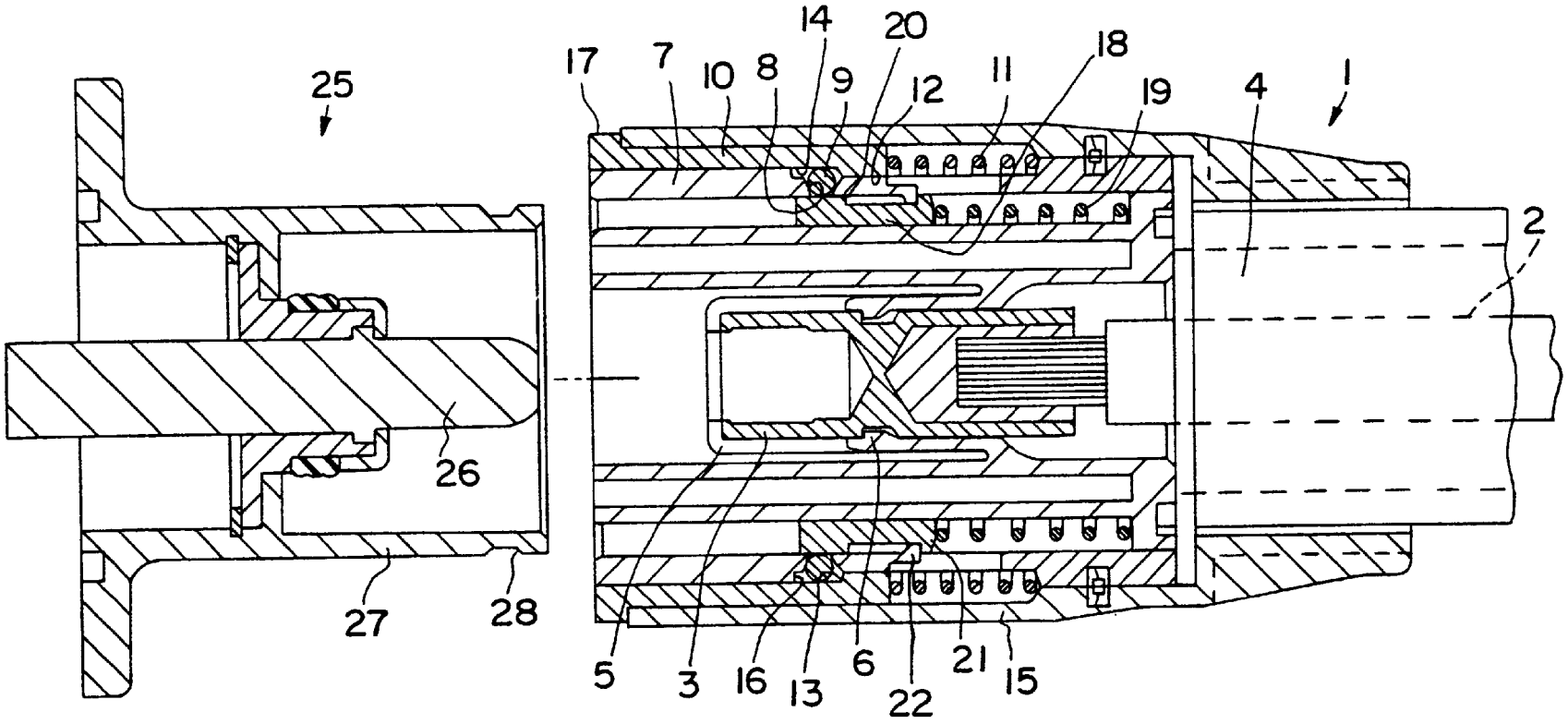
FIG. 1 is a section of a first embodiment of the invention in its non-engaged state.

Hereafter, a first embodiment of the invention is described with reference to FIGS. 1 and 2.

A charging connector 1 according to this embodiment is connected with a charger (not shown) via a wire 2, and is engageable with a vehicle-side connector 25 secured to a body of an electric vehicle (not shown) to charge a battery mounted on the vehicle.

A male terminal 26 secured to an end of a wire (not shown) connected with the battery is secured to the vehicle connector 25, and projects into a hood 27 formed at a front portion of the vehicle-side connector 25. When the charging connector 1 is engaged with the vehicle-side connector 25, the terminal 26 and a terminal 3 of the charging connector 1 are electrically connected.

In the hood 27 of the vehicle-side connector 25, there is formed an engaging groove 28 as an element for the construction of a locking mechanism for locking the connectors 1 and 25. The engaging groove 28 is formed in the outer surface of the leading end of the hood 27 over its entire circumference, and a front inner wall surface of the engaging groove 28 is sloped.

The charging connector 1 includes the female terminal 3 secured to an end of the wire 2 extending from the charger. The terminal 3 is held in a cylindrical terminal retainer 5 projecting forward from a connector housing 4 by a lance or engaging member 6, and the wire 2 extends backward through a hollow space within the connector housing 4.

The connector housing 4 is integrally or unitarily formed with a cylindrical engaging portion 7 projecting forward in such a manner as to cover the terminal retainer 5. The hood 27 of the vehicle-side connector 25 is slidably fittable into the engaging portion 7 in contact with the inner surface thereof. A plurality of (e.g. 8) ball support holes 8 are formed in the engaging portion 7, circumferentially and equally spaced by a specified angle, so as to open in the outer and inner surfaces of the engaging portion 7. The ball support holes 8 are so arranged as to conform to the engaging groove 28 when the hood 27 is engaged with the engaging portion 7. Lock balls 9 having in particular a diameter larger than the thickness of the engaging portion 7 at least in proximity of the ball support holes 8, are fitted in the ball support holes 8 such that they are substantially free to move in radial and/or longitudinal or tangential directions.

A locking member 10 having such a cylindrical shape as to be in contact with the outer surface of the engaging portion 7 is fitted on the engaging portion 7. The locking member 10 is slidable along a longitudinal direction between a forward located lock position and a backward located unlock position, and is biased toward the lock position by a lock spring 11. Here, the lock position and the unlock position of the locking members 10 are described.

Figure 2:
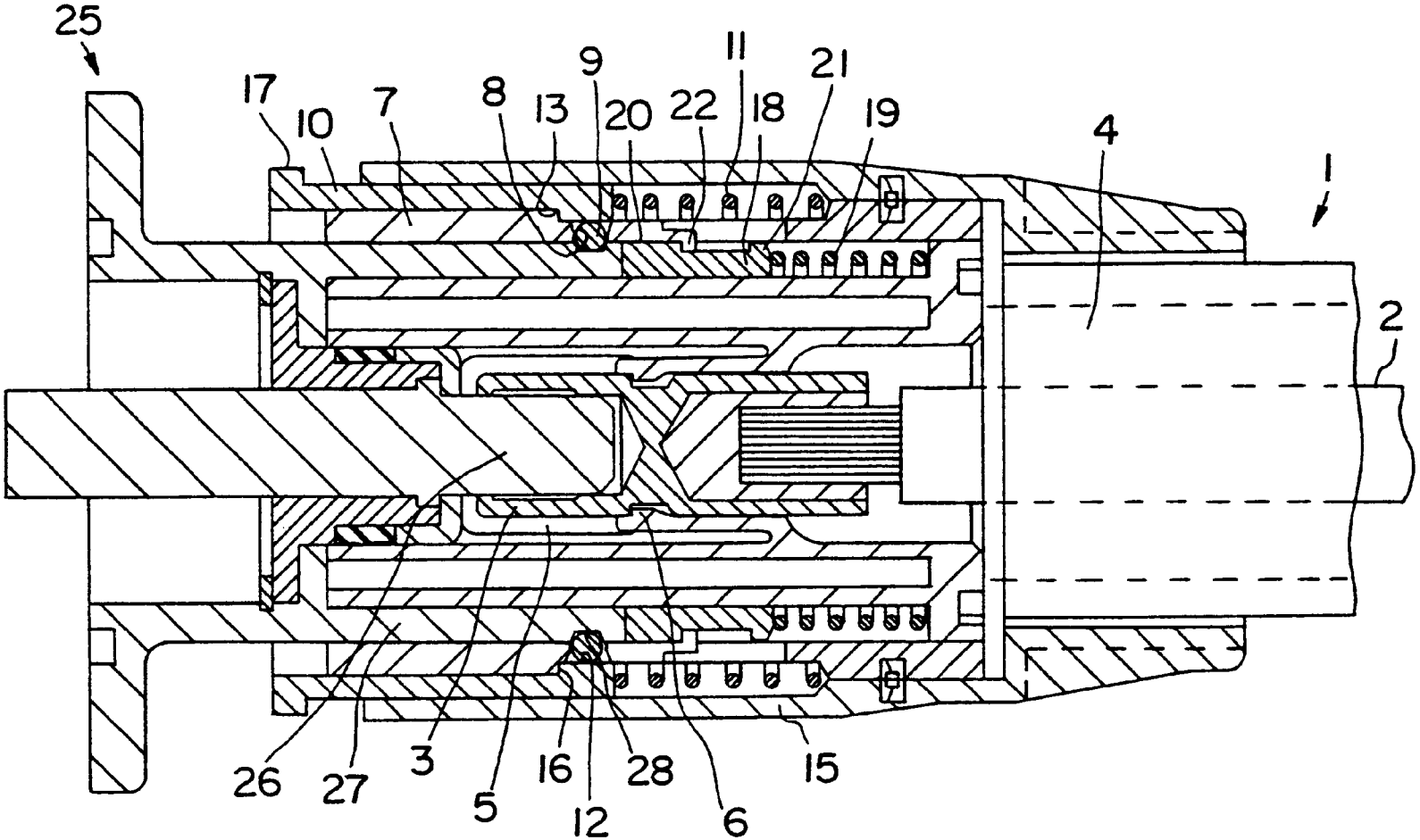
FIG. 2 is a section of the first embodiment in its engaged state.

When the locking member 10 is in its lock position, a ball pressing face 12 formed on the inner surface of the rear end of the locking member 10 closes the ball support holes 8 from outside as shown in FIG. 2. The ball pressing face 12 engages the lock balls 9 to hold them in such a manner as to project toward the inward of the engaging portion 7. In this state, the lock balls 9 are fitted into the engaging groove 28 of the hood 27 of the vehicle-side connector 25 properly fitted into the engaging portion 7, with the result that the charging connector 1 and the vehicle-side connector 25 are locked. At this time, a locking portion 13 is engaged with a stopper 16 of the engaging portion 7, thereby restricting a movement of the locking member 10 forwardly from the lock position.

When the locking member 10 is in its unlock position, a recess 14 formed forward of and having a larger diameter than the ball pressing face 12 faces the ball support holes 8 as shown in FIG. 1, and the lock balls 9 projecting toward the inward of the engaging portion 7 retract into the ball support holes 8, being permitted to project toward the outward of the engaging portion 7. While the lock balls 9 are so held as to project toward the outward of the engaging portion 7, the movement of the locking member 10 toward its lock position (forward) is restricted even if the locking portion 13 biased by the lock spring 11 presses the lock balls 9. While the projecting lock balls 9 are permitted to move toward the inward of the engaging portion 7, they are pressed by the locking portion 13 biased by the lock spring 11 to move toward the inward of the engaging portion 7, with the result that the locking member 10 moves to its lock position.

The connector housing 4 is provided with an outer cylinder 15 for covering the locking member 10 and the lock spring 11. A finger hook or jaw portion 17 formed at the front end of the locking member 10 projects from the front end of the outer cylinder 15. By pulling the finger hook 17 with finger, the locking member 10 can be moved toward its unlock position.

An unlocking member 18 having such a cylindrical shape as to be substantially in contact with the inner surface of the engaging portion 7 is slidably fitted in the engaging portion 7 along the longitudinal direction between a forward located unlock position and a backward located lock permitting position. The unlocking member 18 is biased toward its unlock position by an unlock spring 19 and is pressed to its lock permitting position by the front end of the hood 27 when the hood 17 of the mating connector is fitted into the engaging portion 7.

While the unlocking member 18 is in its unlock position, a ball receiving face 20 formed on the outer surface of the front end of the unlocking member 18 closes the ball support holes 8 and engages the lock balls 9, thereby holding the lock balls 9 in such a manner as to project toward the outward of the engaging portion 7. At this time, a locking portion 21 of the unlocking member 18 is engaged with a stopper 22 of the engaging portion 7, thereby restricting a movement of the unlocking member 18 forwardly from its unlock position.

While the unlocking member 18 is in its lock permitting position, it moves backwardly from the ball support holes 8, thereby opening the inner sides of the ball support holes 8. As a result, the lock balls 9 are permitted to project toward the inward of the engaging portion 7 and to be engaged with the vehicle-side connector 25.

Next, how this embodiment operates is described.

In the charging connector 1 not engaged with the vehicle-side connector 25, as shown in FIG. 1, the unlocking member 18 is biased by the unlock spring 19 and located in its unlock position; the lock balls 9 project toward the outward of the engaging portion 7; and the locking member 10 is held in its unlock position against the biasing force of the lock spring 11.

When the charging connector 1 is engaged with the vehicle-side connector 25, the hood 27 of the mating connector 25 is fitted into the engaging portion 7, thereby pressing the unlocking member 18 to its lock permitting position. When both connectors 1 and 25 are properly engaged and the engaging groove 28 of the hood 27 conforms to the ball support holes 8, the biasing force of the lock spring 11 causes the lock balls 9 to project toward the inward of the engaging portion 7 and to engage the engaging groove 28 and also causes the locking member 10 to move to its lock position. In this state, the ball pressing face 12 engages the lock balls 9 from outside to hold them engaged with the engaging groove 28. As a result, the connectors 1 and 25 are locked (see FIG. 2).

When the charging connector 1 is disengaged, the outer cylinder 15 is held in one hand and its fingers (e.g. a thumb and a forefinger) are placed on the finger hook 17 to pull it back toward the front (toward the right side in FIG. 2) against the biasing force of the lock spring 11. Thereby, the locking member 10 moves to its unlock position and the ball pressing face 12 is disengaged from the lock balls 9, permitting the lock balls 9 to displace toward the inward of the engaging portion 7. Then, the biasing force of the unlock spring 19 causes the unlocking member 18 to move to its unlock position while relatively pressing the hood 27 forward, and also pushes the lock balls 9 out of the engaging groove 28. The lock balls 9 are so held as to project toward the outward of the engaging portion 7 by engagement of the ball receiving face 20 from inside. The locking portion 13 engages the projecting lock balls 9, with the result that the locking member 10 is held in its unlock position, returning to the state shown in FIG. 1.

As described above, according to this embodiment, the connectors 1 and 25 are locked by the ball lock mechanism for engaging the lock balls 9 displaceable in the ball support holes 8 with the vehicle-side connector 25. As compared with a lock mechanism adopting an elastically deformable resin lance or engaging member, a better reliability can be ensured because the connectors can be securely locked even if the connector and the cable are heavy.

When the charging connector 1 and the vehicle-side connector 25 are engaged, these connectors are automatically locked. Further, the connectors 1 and 25 are unlocked only by displacing the locking member 10 to its unlock position. Accordingly, a good operability can be ensured.

Furthermore, the connectors can be unlocked while the connector housing 4 is held in one hand, and in the same direction as they are disengaged. Thus, a good operability can be ensured in this respect as well.

Next, a second embodiment of the invention is described with reference to FIGS. 3 and 4.

A charging connector 30 of this embodiment is connected with a charger (not shown) via wires 61, and is engaged with a vehicle-side connector 60 secured to a body of an electric vehicle (not shown) to charge a battery mounted on the vehicle.

Male terminals 62 secured to ends of wires 61 connected with the battery are secured to the vehicle connector 60, and project into a hood 63 formed at a front portion of the vehicle-side connector 60. When the charging connector 30 is engaged with the vehicle-side connector 60, the terminal 62 and terminals 35 of the charging connector 30 are electrically connected.

In the hood 63 of the vehicle-side connector 60, there is formed an engaging groove 64 as an element for the construction of a locking mechanism for locking the connectors 30 and 60. The engaging groove 64 is formed in the outer surface of the leading end of the hood 63 over its entire circumference.

The charging connector 30 includes a connector housing 31 having a terminal holder 32 and a grip 33, and the female terminals 35 secured to ends of wires 34 extending from the charger. The terminals 35 are held in the terminal holder 32, and the wires 34 extending from the terminal holder 32 further extend backward from a position below the grip 33.

A cylindrical engaging portion 36 is so secured to the terminal holder 32 of the connector housing 31 as to cover the terminal holder 32. The hood 63 of the vehicle-side connector 60 is fittable into the engaging portion 36 in sliding contact with the inner surface of the engaging portion 36. A plurality of (e.g. 8) ball support holes 37 are formed in the engaging portion 36, circumferentially and equally spaced by a specified angle, so as to open in the outer and inner surfaces of the engaging portion 36. The ball support holes 37 are so arranged as to conform to the engaging groove 64 when the hood 63 is engaged with the engaging portion 36. Lock balls 38 having a diameter in particular larger than the thickness of the engaging portion 36 particularly at least in proximity of the ball support holes 37, are fitted in the ball support holes 37 such that they are substantially free to move in radial and/or tangential directions.

A locking member 39 having such a cylindrical shape as to be in contact with the outer surface of the engaging portion 36 is fitted on the engaging portion 7. The locking member 39 is slidable along a longitudinal direction between a forward located lock position and a backward located unlock position, and is biased toward the lock position by a lock spring 40.

When the locking member 39 is in its lock position, a ball pressing face 41 formed on the inner surface of the locking member 39 closes the ball support holes 37 from outside.

The ball pressing face 41 engages the lock balls 38 to hold them in such a manner as to project toward the inward of the engaging portion 36.

When the locking member 39 is in its unlock position, a groove 42 formed forward of the ball pressing face 41 faces the ball support holes 37, and the lock balls 38 projecting toward the inward of the engaging portion 36 retract into the ball support holes 37, being permitted to project outwardly of the engaging portion 36 and engage the groove 42. While the lock balls 38 are so held as to engage the groove 42, the movement of the locking member 39 toward its lock position (forward) is restricted. Further, while the lock balls 38 are permitted to move inwardly of the engaging portion 36 despite their engagement with the groove 42, they are pressed against the edge of the groove 42 by the biasing force of the lock spring 40 to move inwardly of the engaging portion 36, with the result that the locking member 39 moves to its lock position.

A connection member 39*a* projecting from the rear end of the locking member 39 is connected, by a shaft 44, with one end of a link arm 43 pivotally supported by a shaft 46. At the other end of the link arm 43, there is formed a ring-shaped trigger (operable member as an element for the construction of the invention) 45. These elements construct a linking mechanism as an element for the construction of the invention. The trigger 45 is pivotal upward and downward about the shaft 46 by being guided along a guide groove 48. If the forefinger of the hand holding the grip 33 is put on the trigger 45 to pull it upward, the locking member 39 moves from its lock position to its unlock position.

An unlocking member 50 having such a cylindrical shape as to be substantially in contact with the inner surface of the engaging portion 36 is slidably fitted in the engaging portion 36 along the longitudinal direction between a forward located unlock position and a backward located lock permitting position. The unlocking member 50 is biased toward its unlock position by an unlock spring 51 and is pressed to its lock permitting position by the front end of the hood 63 when the hood 63 of the vehicle-side connector 60 is fitted into the engaging portion 36.

While the unlocking member 50 is in its unlock position, the outer surface thereof closes the ball support holes 37, engages the lock balls 38, and holds them in such a manner as to project toward the outward of the engaging portion 37. At this time, a locking portion 52 of the unlocking member 50 is engaged with a stopper 53 of the engaging portion 36, thereby restricting a movement of the unlocking member 50 forwardly from its unlock position.

On the other hand, while the unlocking member 50 is in its lock permitting position, it moves backwardly from the ball support holes 37, thereby opening the inner sides of the ball support holes 37. As a result, the lock balls 38 are permitted to project toward the inward of the engaging portion 36 and engage the vehicle-side connector 60.

Next, how this embodiment operates is described.

Figure 3:
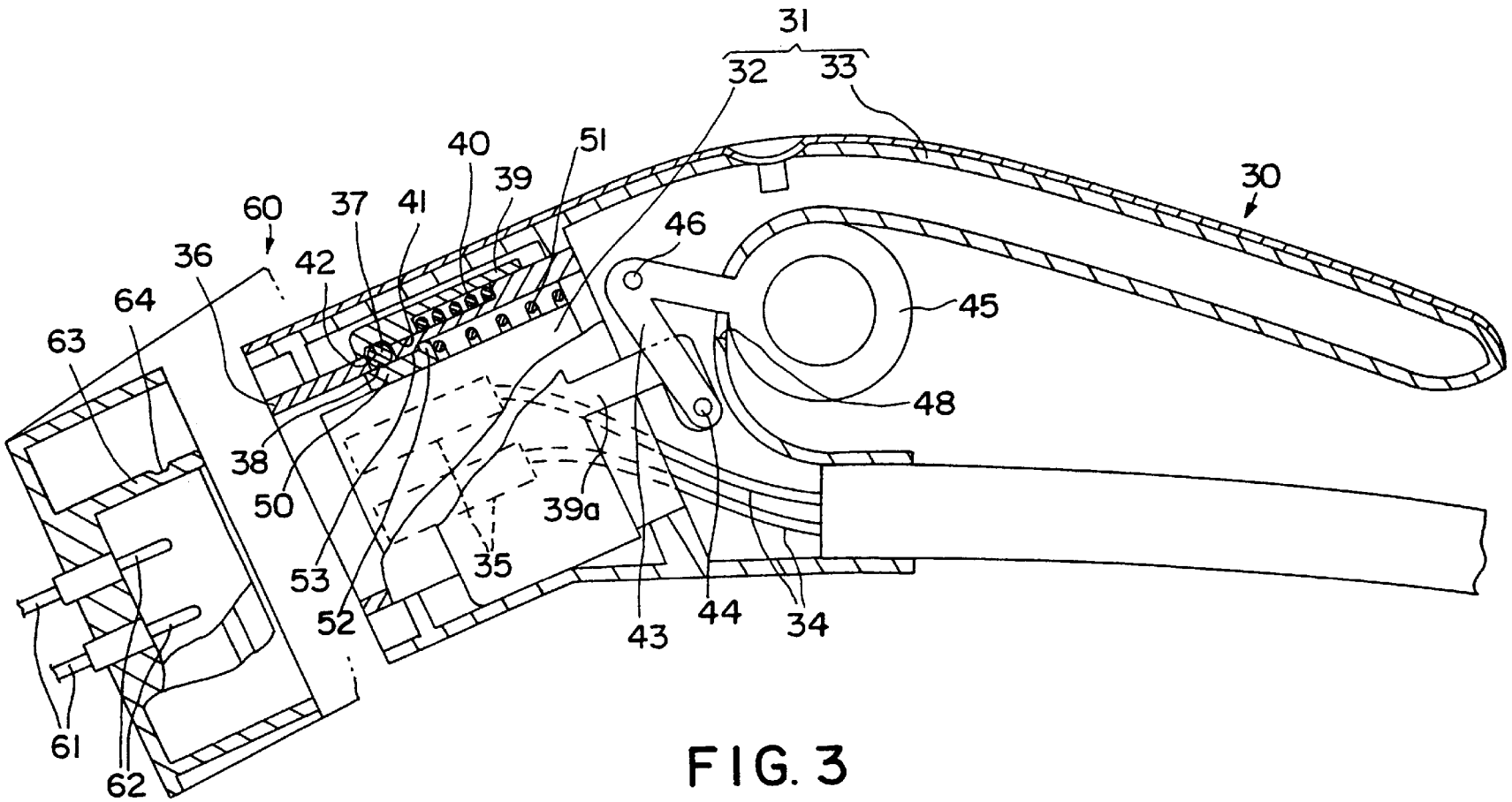
FIG. 3 is a section of a second embodiment in its non-engaged state.
Figure 4:
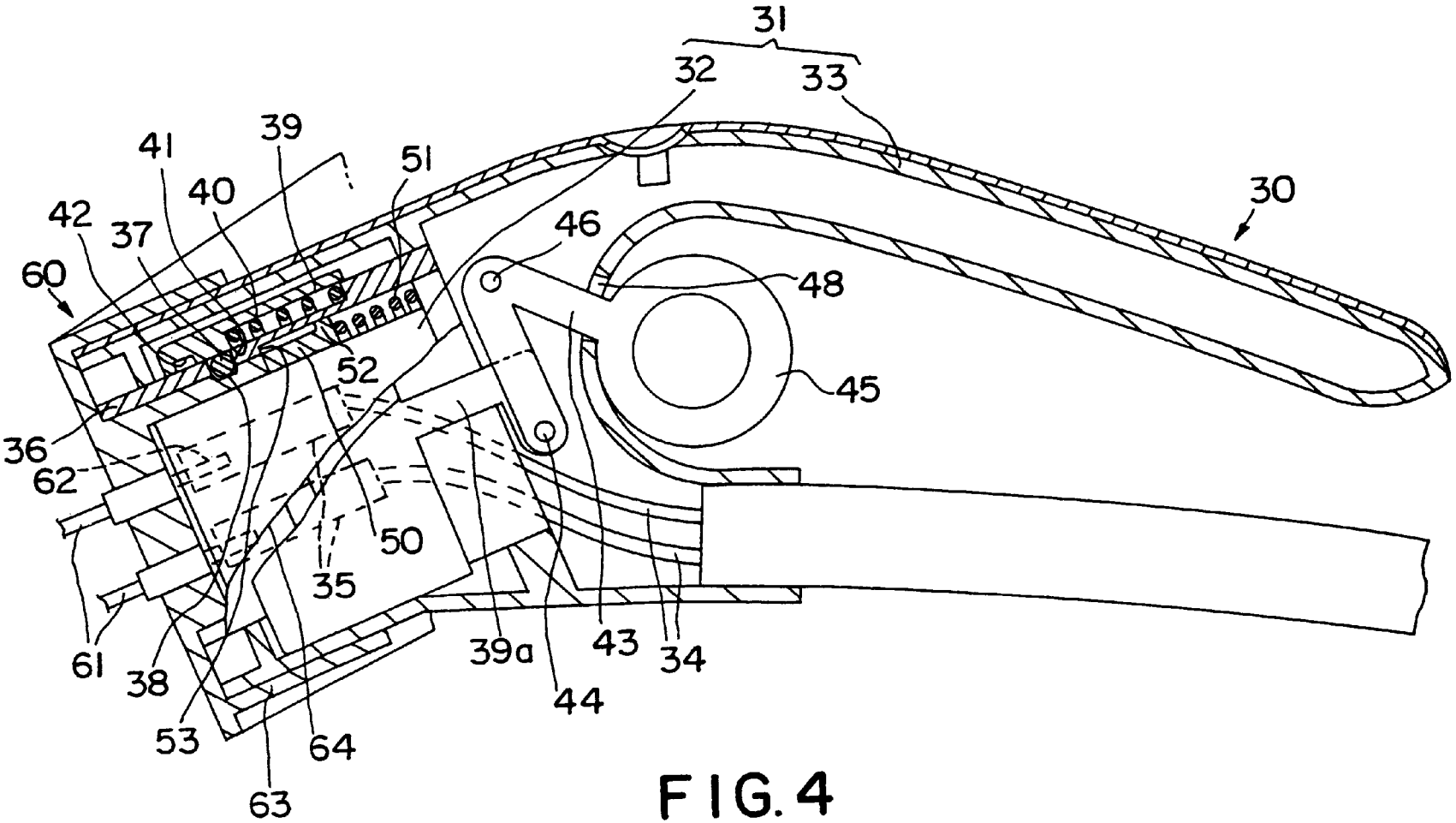
FIG. 4 is a section of the second embodiment in its engaged state.

In the charging connector 30 not engaged with the vehicle-side connector 60, as shown in FIG. 3, the unlocking member 50 is biased by the unlock spring 51 and located in its unlock position; the lock balls 38 project toward the outward of the engaging portion 36 and are engaged with the groove 42; and the locking member 39 is held in its unlock position against the biasing force of the lock spring 40.

When the charging connector 30 is engaged with the vehicle-side connector 60, the hood 63 of the vehicle-side connector 60 is fitted into the engaging portion 36, thereby pressing the unlocking member 50 to its lock permitting position. When both connectors 30 and 60 are properly engaged and the engaging groove 64 of the hood 63 conforms to the ball support holes 37, the biasing force of the lock spring 40 causes the lock balls 38 to project toward the inward of the engaging portion 36 and engage the engaging groove 64 and also presses the locking member 39 to its lock position. In this state, the ball pressing face 41 engages the lock balls 38 from outside and holds them engaged with the engaging groove 64. As a result, both connectors 30, 60 are locked (see FIG. 4).

When the charging connector 30 is disengaged, the grip 33 is held in one hand and its forefinger is put on the trigger 45 to pull it up against the biasing force of the lock spring 40. Thereby, the locking member 39 moves to its unlock position and the ball pressing face 41 is disengaged from the lock balls 38. When the groove 42 reaches a position where it conforms to the ball support holes 37, the biasing force of the unlock spring 51 causes the unlocking member 50 to move to its unlock position while relatively pressing the hood 63 forward, and also pushes the lock balls 38 out of the engaging groove 64 and holds them engaged with the groove 42. The locking member 39 is held in its unlock position by engagement of the lock balls 38 with the groove 42, returning to the state shown in FIG. 3.

As described above, the second embodiment has the same effects as the first embodiment. In addition, since the connectors can be unlocked while the grip 33 is held in one hand, a better operability can be ensured as compared with the case where the connectors are unlocked while the connector housing 31 having a large diameter is held as in the first embodiment.

The present invention is not limited to the embodiments described and shown in the drawings. The following embodiments are also embraced by the technical scope of the present invention as defined by the claims. Beside the following embodiments, a variety of changes are possible without departing from the spirit and scope of the present invention as defined by the claims.

(1) Although the foregoing embodiments are described with respect to the case where the locking mechanism operates in the charging connector, the invention is applicable to a case where the locking mechanism operates in the vehicle-side connector.

(2) Although the foregoing embodiments are described with respect to the case where the lock spring is provided, the invention is applicable to a construction not adopting the lock spring. In such a case, the lock balls may be locked by manually moving the locking member to its lock position.

(3) Although the foregoing embodiments are described with respect to the case where the unlock spring is provided, the invention is applicable to a construction not adopting the unlock spring. In such a case, the lock balls may be unlocked while detaching the connector housing from the mating connector. If the lock spring is provided in the construction not adopting the unlock spring, it is necessary to manually operate the unlocking member to unlock the lock balls and to hold the unlocking member in its unlock position.

(4) The invention is applicable not only to connectors of the above types, but also to connectors of the type in which a button is provided on the outer surface of the cylindrical connector housing and the connectors are unlocked by pressing this button.

(5) In the first embodiment, there may be provided a means for restricting a movement of the locking member 10 toward its unlock position while the connectors 1 and 25 are engaged. This means for holding the locking member in its lock position may be such a button that normally acts to restrict the movement of the locking member 10 toward its unlocking position and permits this movement of the locking member 10 when being pressed. With such a construction, the connectors can be unlocked by two operations: by pressing the button and sliding the locking member 10.

Figure 5:
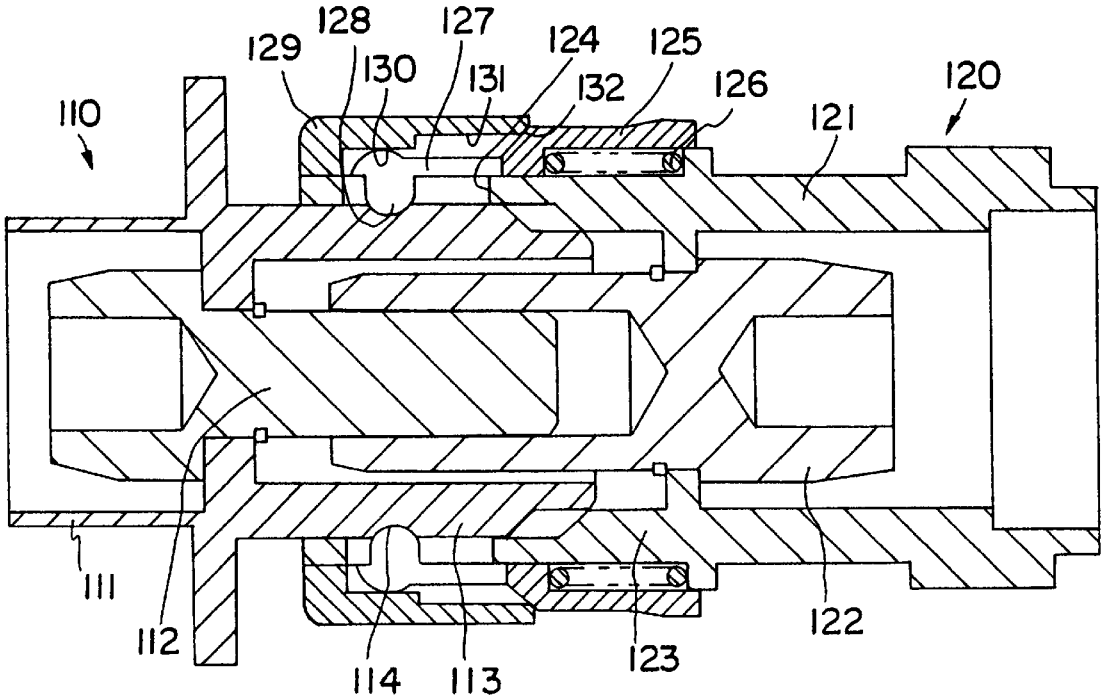
FIG. 5 is a section of a third embodiment according to the invention in its locked state.
Figure 6:
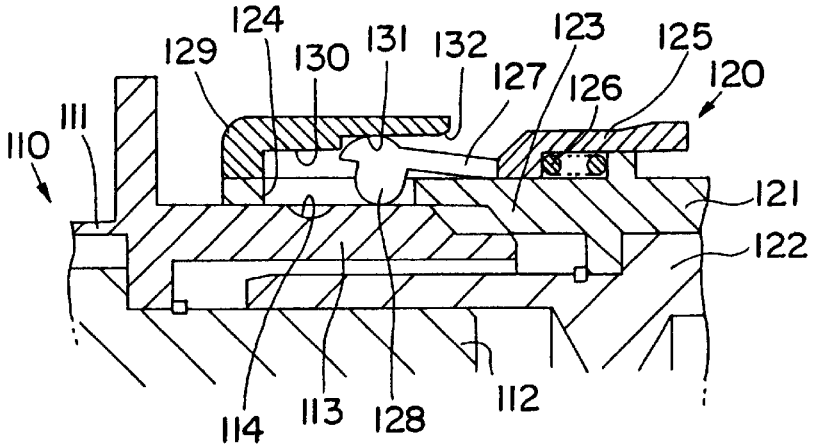
FIG. 6 is a partial section of the third embodiment showing a state where elastic engaging members are elastically displaced.

Hereafter, a third embodiment of the invention is described with reference to FIGS. 5 and 6.

A male connector 110 (a mating connector as an element for the construction of the present invention) is such that a male terminal 112 is housed in a connector housing 111 which is cylindrically shaped as a whole and that an engaging groove 114 having an arcuate cross section formed in the outer surface of a forward extending hood 113 over its entire circumference. A locking projection 128 of a female connector 120 to be described later is engaged with the engaging groove 114, thereby locking the male connector 110 and the female connector 120.

The female connector 120 is such that a female terminal 122 is housed in a connector housing 121 which is cylindrically shaped as a whole. The hood 113 of the male connector 110 is fitted into a forward extending engaging portion 123 such that the outer surface of the hood 113 is in contact with the inner surface of the engaging portion 123. Communication holes 124 having particularly an oblong shape and extending along a longitudinal direction are formed in the wall of the engaging portion 123 in preferably four circumferentially spaced positions by 90° so as to communicate the inside and outside of the engaging portion 123.

A locking member 125 which is preferably cylindrically shaped as a whole is movably fitted around the outer surface of the engaging portion 123 along the longitudinal direction (an engaging direction with the male connector 110). The locking member 125 is biased forward by a lock spring 126, and is normally held in a forward located lock position (shown in FIG. 1) by the biasing force of the lock spring 126. The locking member 125 is displaceable to a backward located unlock position (shown in FIG. 2) against the biasing force of the lock spring 126.

Four elastic engaging members 127 are integrally or unitarily formed with the locking member 125. The engaging members 127 project forward from positions at the front edge of the locking member corresponding to the four communication holes 124. The engaging members 127 are displaceable, particularly elastically displaceable in radial directions between their engaging positions (shown in FIG. 1) and their retracted positions (shown in FIG. 2) which are located more outwardly than the engaging positions. An inward projecting locking projection 128 is formed at the leading end of each engaging member 127. The locking projections 128 are preferably semicircularly shaped and engageable with the engaging groove 114 of the male connector 110. When the engaging members 127 are in their engaging positions, the locking projections 128 project toward the inward of the engaging portion 123 through the communication holes 124. On the other hand, when the engaging members 127 are in their retracted positions, the locking projections 128 are located in the communication hole 124.

A cylindrical deformation restricting member 129 which overhangs backward is secured to the outer surface of the front end of the engaging portion 123. A front portion of the member 129 having a smaller inner diameter acts as a restricting portion 130, and a rear portion thereof having a larger inner diameter acts as a permitting portion 131.

The restricting portion 130 faces the elastic engaging members 127 when the locking member 125 is in its lock position, and the inner diameter thereof is set equal to the outer diameter of the elastic engaging members 127. Accordingly, when the locking member 125 is in its lock position and the elastic engaging members 127 are in their engaging positions, the displacement of the elastic engaging members 127 to their retracted positions is restricted by the restricting portion 130.

Further, the permitting portion 131 faces the elastic engaging members 127 when the locking member 125 is in its unlock position and, in this state, the elastic displacement of the elastic engaging members 127 to their retracted positions is permitted.

The rear end of the deformation restricting member 129 forms a stopper 132 for preventing the locking member 125 in its lock position from moving further forward.

Next, how this embodiment operates is described.

Upon start of the engagement of the male connector 110 and the female connector 120, the front edge of the outer surface of the hood 113 of the male connector 110 comes into contact with the locking projections 128 projecting toward the inward of the engaging portion 123, thereby pressing them. However, since the outward displacement of the elastic engaging members 127 is restricted by the restricting portion 130, the locking member including the locking projections 128 and the elastic engaging members 127 are pressed backward against the biasing force of the lock spring 126.

When the elastic engaging members 127 move from an area where they face the restricting portion 130 to an area where they face the permitting portion 131, the backward movement of the locking member 125 is stopped; the engaging members 127 are elastically deformed toward the outward; and the locking projections 128 are retracted into the communication holes 124 (see FIG. 2). Thereafter, the connectors 110 and 120 are further engaged while the outer surface of the hood 113 and the locking projections 128 are in sliding contact with each other.

When the engaging groove 114 reaches a position where it conforms to the locking projections 128 as the connectors 110 and 120 are further engaged, the elastic engaging members 127 are elastically deformed inward due to their elastic restoring forces or due to external means e.g. a (not shown) spring, with the result that the locking projections 128 are engaged with the engaging groove 114. Then, the locking member 125 moves forward by the biasing force of the lock spring 126, and the male connector 110 is relatively pressed backward. The engagement is completed when the locking member 125 reaches its lock position. At this time, since the elastic engaging members 127 face the restricting portion 130 and the displacement thereof toward the outward is restricted, the locking projections 128 and the engaging groove 114 are held engaged. As a result, the connectors 110 and 120 are securely locked.

In order to disengage the connectors 110 and 120, they are temporarily pressed against each other. Then, the locking member 125 moves from its lock position to its unlock position and the elastic engaging members 127 move from where they face the restricting portion 130 to where they face the permitting portion 131, thereby enabling the disengagement of the connectors 110 and 120. In this state, an attempt is made to detach the connectors 110 and 120 from each other while the locking member 125 is held in its unlock position by hand. Then, the locking projections 128 are disengaged from the engaging groove 114 while the elastic engaging members 127 are elastically deformed outward due to the arcuate surfaces of the locking projections 128, thereby unlocking the connectors 110 and 120. Consequently, the connectors 110 and 120 are detached after passing through a stage of FIG. 2.

As described above, instead of the lock balls, the locking projections 128 having a function similar to that of the lock balls are integrally or unitarily formed with the elastic engaging member 127 in the foregoing embodiment. This leads to a reduced number of parts and makes the assembling easier as compared with the case where the lock balls are used.

The present invention is not limited to the embodiment described and shown in the drawings. The following embodiments are also embraced by the technical scope of the present invention as defined by the claims. Beside the following embodiments, a variety of changes are possible without departing from the spirit and scope of the present invention as defined by the claims.

(1) Although the foregoing embodiment is described with respect to the case where the elastic engaging members are engaged with the mating connector from outside, the construction according to the invention may be such that the elastic engaging members are engaged with the mating connector from inside.

(2) Although the lock spring is provided in the foregoing embodiment, the locking member may be manually moved without providing the lock spring.

(3) Although the foregoing embodiment is described with respect to the case where the deformation restricting member is fixed and the locking member is movable, the construction according to the invention may be such that the locking member is fixed and the deformation restricting member is movable.

(4) A resin coating or a metal piece may be applied to the surface of each locking projection according to the foregoing embodiment. This results in an improved abrasion resistance of the locking projections.

What is claimed is:

1. A locking device for locking a first electrical connector with a second electrical connector inserted into the first electrical connector, comprising:

an engaging means comprising a locking part for engagement with the inserted second connector, the locking part being displaceable in an insertion direction relative to both the first electrical connector and the inserted second electrical connector and in a radial direction transverse to the insertion direction between an engaging position where the locking part is substantially engaged with the second connector and a radially outer retracted position where the locking part is substantially disengaged from the second connector, the engaging means comprising an elastic engaging member that is elastically displaceable in a radial direction between the engaging position and the retracted position, the engaging means being movable along the insertion direction relative to the second connector between a lock position and an unlock position, a lock spring for biasing the engaging means toward its lock position, and a deformation restricting member capable of restricting elastic deformation of the elastic engaging member to its retracted position.

2. A locking device according to claim 1, wherein the engaging means projects from a cylindrical locking member, which is fitted around the outer surface of a connector housing and the locking part projects inward of the housing, and wherein the engaging means restricting member is a substantially cylindrical member fitted around the outer surface of the engaging means.

3. A locking device according to claim 2, wherein the engaging means projects unitarily from the cylindrical locking member.

4. A locking device according to claim 3, wherein the locking part projects unitarily from the engaging means.

5. A locking device according to claim 3, wherein the locking part includes an arcuate inwardly facing surface.

6. A connector assembly comprising:

a male connector having a male terminal and a hood with a generally tubular portion having inner and outer circumferential surfaces, said inner circumferential surface of said hood being concentrically outward from said male terminal to define an annular space therebetween, said outer circumferential surface of said hood having an annular groove of arcuate cross-section extending circumferentially thereabout;

a female connector having a female terminal configured for mating engagement with the male terminal and for sliding insertion into to the annular space between the male terminal and the hood of the male connector, a housing rigidly mounted to the female terminal and having a tubular portion with an inner circumferential surface spaced concentrically outwardly from the female terminal and dimensioned for sliding engagement over at least a portion of the hood of the male terminal, said housing further having an outer circumferential surface, a plurality of communication holes extending through the tubular portion of the housing and disposed for registration with the annular groove of the hood when the male and female connectors are mated; and a locking member having a cylindrical wall slidably mounted around a portion of the outer circumferential surface of the housing of the female connector and a plurality of elastic engaging members projecting in an axial direction from said cylindrical wall, each said elastic engaging member having an arcuate locking projection substantially congruent in shape to the arcuate cross-section of the groove in the hood, said locking projections of said locking member being movably disposed in the respective communication holes through the tubular wall of the housing of the female connector, each said locking projection being dimensioned such that in a first alignment of the respective elastic engaging member said locking projection is spaced radially outwardly from said annular groove for permitting mating and unmating of said male and female connectors and such that in a second position of said elastic engaging members, said locking projections are engaged in the groove of the hood for holding the male and female connectors in a mated condition, whereby the communication holes guide and protect the locking projections during mating and unmating of the connectors.

7. The connector assembly of claim 6, wherein the outer circumferential surface of the hood is unthreaded.

8. The connector assembly of claim 6, wherein the housing of the female connector includes an open front end for receiving the hood of the male connector, the communication holes in the housing being spaced rearwardly from the front end of the housing, the female connector further comprising a deformation restricting portion rigidly mounted to the front end of the housing, the deformation restricting portion including a tubular wall extending, rearwardly from said front end of said housing and spaced concentrically outwardly from said outer circumferential surface of said housing, said tubular wall of said deformation restricting member extending rearwardly beyond said communication holes in said housing and overlying said elastic engaging members, such that said deformation restricting member limits outward deformation of said elastic engaging members.

9. The connector assembly of claim 8, wherein the tubular portion of the deformation restricting member include an inner surface having a small diameter cylindrical portion substantially adjacent the connection of the deformation restricting member to the housing and a large diameter cylindrical portion adjacent to and rearwardly of the small diameter cylindrical portion, said small diameter cylindrical portion of the deformation restricting member having a diameter for holding the locking projections of the elastic engaging members in an inward position for engaging the groove of the hood on the male connector, the large diameter portion of the deformation restricting member being dimensioned for permitting outward deflection of the elastic engaging members to a position spaced from said hood but within the respective communication hole of the housing.

10. The connector assembly according to claim 9, further comprising a spring disposed between the cylindrical wall of the locking member and the outer surface of the housing for urging the locking member toward the front end of the housing, the deformation restricting member being dimensioned to limit movement of the locking member toward the front end of the housing.

* * * * *